US005176154A

United States Patent [19]

Sagawa et al.

[11] Patent Number: 5,176,154

[45] Date of Patent: Jan. 5, 1993

[54] APPARATUS FOR ALTERNATELY ARRANGING THE DIRECTION OF AN ARTICLE

[75] Inventors: Takayoshi Sagawa; Toshiaki Okuzawa; Takashi Koyama, all of Yokohama, Japan

[73] Assignee: Japan Tobacco Inc., Tokyo, Japan

[21] Appl. No.: 687,009

[22] Filed: Apr. 18, 1991

[30] Foreign Application Priority Data

Apr. 19, 1990 [JP] Japan ..... 2-101840

[51] Int. Cl.[5] ..... A24C 5/47

[52] U.S. Cl. ..... 131/282; 131/94; 198/374

[58] Field of Search ..... 131/282, 57.5, 27.1, 131/94; 198/374

[56] References Cited

U.S. PATENT DOCUMENTS

| | | | |
|---|---|---|---|
| 2,798,495 | 7/1957 | Molins | 131/94 |
| 2,882,970 | 4/1959 | Schur | 131/94 |
| 3,026,879 | 3/1962 | Molins et al. | 131/94 |

*Primary Examiner*—V. Millin
*Assistant Examiner*—J. Doyle
*Attorney, Agent, or Firm*—Birch, Stewart, Kolasch & Birch

[57] ABSTRACT

Annular guide grooves and rotating ratchet wheels are provided, and feed claws formed in said ratchet wheels moves along said annular guide groove in a circumferential direction. Also, first and second supply conveyers are provided, articles are arranged in the same direction and transferred on these supply conveyers, and sent into said annular guide grooves by supply mechanisms. Said first supply conveyer is arranged to be directed in a direction of a contact line of said annular guide grooves and in the same direction as the moving direction of said feed claws. Said second supply conveyer is arranged to be directed in a direction of a contact line of said annular guide grooves and in the opposite direction to the moving direction of said feed claws. The back portions of said articles sent from said first supply conveyer are pressed by said feed claws, and the front portions thereof are moved toward the advancing direction. The front portions of said articles sent from said second supply conveyer are pressed by said feed claws, and said front portions are moved backward the advancing direction. The articles moved in said guide grooves are transferred on an exhaust conveyer. Therefore, the articles are arranged in a state that the directions of the articles are alternately opposed to each other.

4 Claims, 6 Drawing Sheets

APPARATUS FOR ALTERNATELY ARRANGING THE DIRECTION OF AN ARTICLE

BACKGROUND OF THE INVENTION

1. Field of the Invention

The present invention relates to an apparatus for alternately arranging front and back end portions of articles, which differ in their shape, structure and quality of material, and transferring the articles, and more particularly to an apparatus for arranging a water capsule contained in a suction tip of a cigarette such that the front and back end portion are alternately directed.

2. Description of the Related Art

In conventionally, there is disclosed a cigarette with a filter wherein a water capsule is contained in a suction tip. In this type of cigarette, for example, before a person smokes the cigarette, the suction tip is broken externally so that the water capsule is broken and water inside is discharged and permeates in the filter. Then, in a case where cigarette smoke flows through the filter containing water at the time of smoking, an irritating component contained in smoke is absorbed in water and mild smoking taste can be obtained.

The above type of cigarette is structured as illustrated, for example, in FIG. 1. A water filter 73 is contained in a casing 72 forming a suction tip of a cigarette 71. The water filter 73 comprises two filter elements 74*a* and 74*b*, and two water capsules are arranged between these filter elements. These filter elements and the water capsules are integrated by a roll of paper 75 which is cylindrically rolled up. The water capsule 2 is formed of plastic material, and a thin portion is partially formed in a bottom wall 30. An opening portion of the water capsule 2 is closed by a cap 20. The cap 20 is formed of a plastic film. In actual, the cap 20 is square-shaped, and the edge portion is flap-shaped and projects along the outer peripheral surface of the water capsule 2 as illustrated in FIGS. 2 and 3. Then, the water capsule 2 is filled with water or a water solution W wherein a predetermined material is dissolved.

In this type of cigarette, before a person smokes the cigarette, the suction tip is broken in an F direction, so that the water capsule 2 is broken. Then, the bottom wall 30 is broken and water inside permeates in the filter element 74*a*.

In a case where such a cigarette with a filter is produced, a long filter corresponding to several filters of the suction tips, thereafter the long filter is cut for one suction tip. Therefore, as shown in FIG. 2, a long filter rod 80 corresponding to several suction tips is produced in order to produce such a filter with a water capsule. The rod 80 is formed by that filter plugs 82*a*, 82*b* and water filter 2 are alternately arranged and integrated by a roll of paper. Then, the rod 80 is cut in the central portion of the respective filter plugs 82*a* and 82*b*, and a filter for one suction tip is produced.

The filter element 74*a*, which is formed in the bottom wall 30 of the water capsule 2, the filter element 74*b*, which is formed in the cap 20, are different from each other in their quality of material. Therefore, in a case where the rod 80 as shown in FIG. 2 is produced, the filter plug 82*a* forming filter element 74*a* and the filter plug 82*b* forming filter element 74*b* are alternately arranged, and the water capsule 2 to be arranged therebetween must be arranged such that the bottom wall 30 and the cap 20 are alternately opposite to each other.

In order that the filter plugs and the water capsule 2 are arranged as mentioned above, supply and transfer apparatus having individual supply mechanism may normally be designed. For example, there are arranged four supply mechanisms, that is, a first supply mechanism for supplying the filter plug 82*a*, a second supply mechanism for supplying the filter plug 80*b*, a third supply mechanism for arranging the cap 20 of the water capsule 2 in the front side of the advancing direction and supplying the capsule 2, and a fourth supply mechanism for arranging the cap 20 of the water capsule 2 in the back side of the advancing direction and supplying the capsule 2. Then, the articles, which are supplied from these supply mechanisms, may be supplied to one transfer apparatus in a predetermined order.

However, in the above-structured apparatus, there are disadvantages in that the structure is complicated and reliability is reduced and the cost of this apparatus increases. Moreover, the above water capsule is supplied in a state that the cap is arranged in a constant direction, that is, the front side of the advancing direction or the back side thereof. Therefore, it is difficult to supply the water capsule to the third supply mechanism in a state that the cap is arranged in the front side. Also, it is difficult to supply the water capsule to the fourth mechanism in a state that the cap is arranged in the backside. Therefore, in order to invert the direction of these water capsules, there is required a complicated apparatus.

Moreover, in the above-structured water capsule, as shown in FIG. 3, if these water capsules 2 are transferred in a state that the caps 20 are arranged in the back side of the advancing direction, flaps f of the edges of the caps 20, which project from the outer periphery surfaces of these water capsules 2, are directed to be opposed to the advancing direction. Due to this, there occurs a disadvantage in which these flaps f catch joint portions of transferring passages 1*a*. Particularly, in cigarette producing apparatuses, recently, there is a tendency for the number of products per unit hour to largely increase. According to this tendency, the number of water capsules to be supplied per unit hour extremely increases. Due to this, the above-mentioned disadvantages become more clear.

SUMMARY OF THE INVENTION

A first object of the present invention is to provide an apparatus wherein front and back end portions of articles, which differ in their shape, structure and quality of material, are arranged and transferred, that is, an apparatus wherein a plurality of articles, which are transferred in a state that their front end portions and the back portions are arranged in the same direction relative to the advancing direction, are arranged such that their front end portions and the back portions are alternately opposed to each other, and transferred.

A second object of the present invention is to provide the above-mentioned apparatus wherein its structure is simplified, reliability is high, and a high speed performance is easily made.

In order to attain the above objects, the present invention has the following features:

The apparatus of the present invention comprises a base for forming an annular guide groove and feeding means. The feeding mean comprises ratchet wheel rotating around the annular guide groove. There are formed feed claws in the ratchet wheel, and the feed claws are moved in the circumferential direction along the annular guide groove by the rotation of the ratchet wheel. Moreover, there are first and second supply conveyers supplying the articles in a state that the front and back portions of the respective articles are arranged in the same direction relative to the advancing direction. The top end portions of these supply conveyers are arranged in a direction of a contact line relative to the annular guide groove. The top end portion of the first supply conveyer is positioned in a direction where the advancing direction of the articles to be supplied on the top end portion is the same as the moving direction of the feed claws. Moreover, the top end portion of the second supply conveyer is positioned in a direction where the advancing direction of the articles to be supplied on the top end portion is opposite to the moving direction of the feed claws. Furthermore, in the top end portions of these supply conveyers, there is provided supply means for supplying the articles fed on these supply conveyers to the annular guide groove. Also, there is provided an exhaust conveyer close to the annular guide groove. Moreover, there is provided exhausting means for exhausting the articles, which are moved in the annular groove by the press of the feed claws, to the exhaust conveyer.

The articles or water capsules are transferred on the first and second supply conveyers in a state that their front portions, that is, the cap sides are directed to the forward side of the advancing direction. The water capsules transferred on the first supply conveyer are supplied to the annular guide groove in a state that the cap sides are directed to the front sides of the water capsules. The water capsules, which were supplied into the annular groove, are pressed by the feed claws from the back sides, that is, the bottom wall sides, and moved along the annular guide groove, and transferred to the exhaust conveyer in a state that the cap sides are directed to the front sides of the capsules. Moreover, the water capsules, which were supplied on the second conveyer, are supplied in the annular guide groove in a state that the cap sides are directed to the front sides of the capsules. However, the water capsules are pressed by the feed claws from the front end portions, that is, the cap sides, and guided in the annular groove. Then, the water capsules are transferred to the exhaust conveyer in a state that the back end portions, that is, bottom wall sides are directed to the front sides.

Therefore, the water capsules supplied from the first supply conveyer are transferred onto the exhaust conveyer in a state that the cap sides are directed to the front sides. The water capsules supplied from the second supply conveyer are transferred onto the exhaust conveyer in a state that the bottom wall sides are directed to the front sides. Due to this, the articles such as water capsules are arranged in a state that their front and back portions are alternately opposed to each other, and transferred onto the exhaust conveyer.

The articles such as water capsules to be transferred on the first and second supply conveyers are transferred in a state that their cap sides are arranged in the front sides relative to the advancing direction. Therefore, the water capsules, which are arranged in the same direction and supplied from the manufacturing apparatus, may be supplied to the first and second supply conveyers as they are, and no special inverting mechanism is required.

Moreover, in order to invert these water capsules, the supplied water capsules may be simply moved along the annular guide mechanism by the feed by the feed claws. Thereby, high reliability can be obtained, and high speed performance of the apparatus can be easily obtained.

Furthermore, in the articles such as water capsules, even if the flaps of the edges of the caps project, all cap sides are arranged in the front side of the advancing direction, so that they can be supplied to the supply conveyer. Due to this, the flaps does not catch the seams of the transferring passages, and high reliability can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
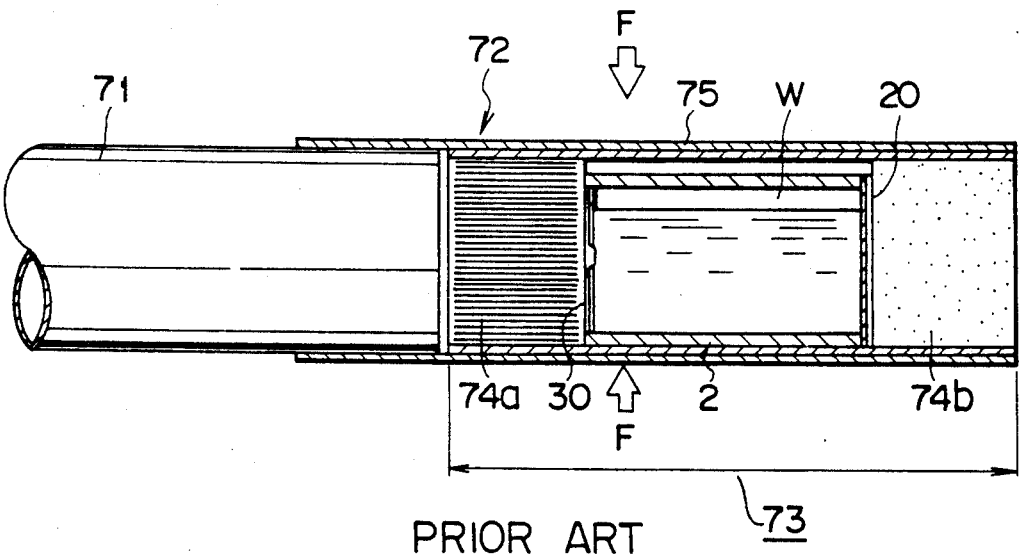
PRIOR ART FIG. 1
FIG. 1 is a vertical cross sectional view of a suction tip of a conventional cigarette with a filter.
Figure 2:
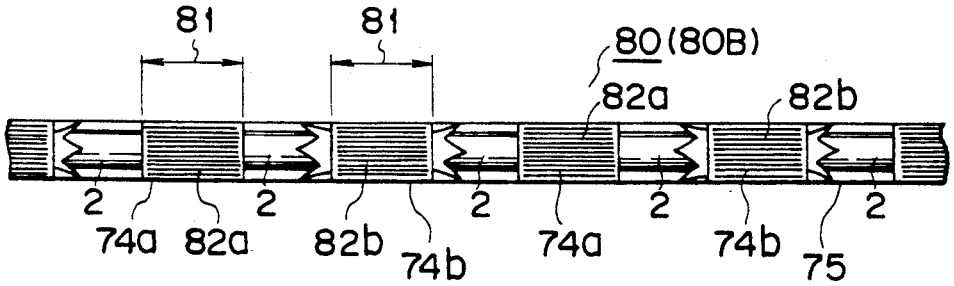
PRIOR ART FIG. 2
FIG. 2 is a schematic vertical cross sectional view of a filter rod of an intermediate product of a conventional water filter.
Figure 3:
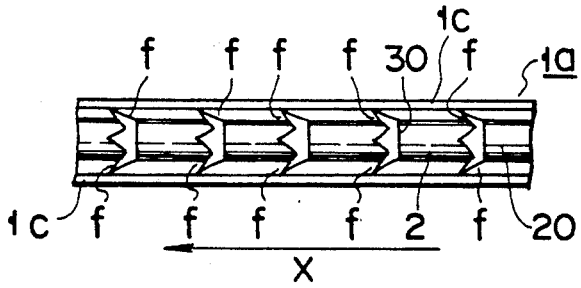
PRIOR ART FIG. 3
FIG. 3 is a schematic side view showing a conventional transferring state of the water capsules.
Figure 4:
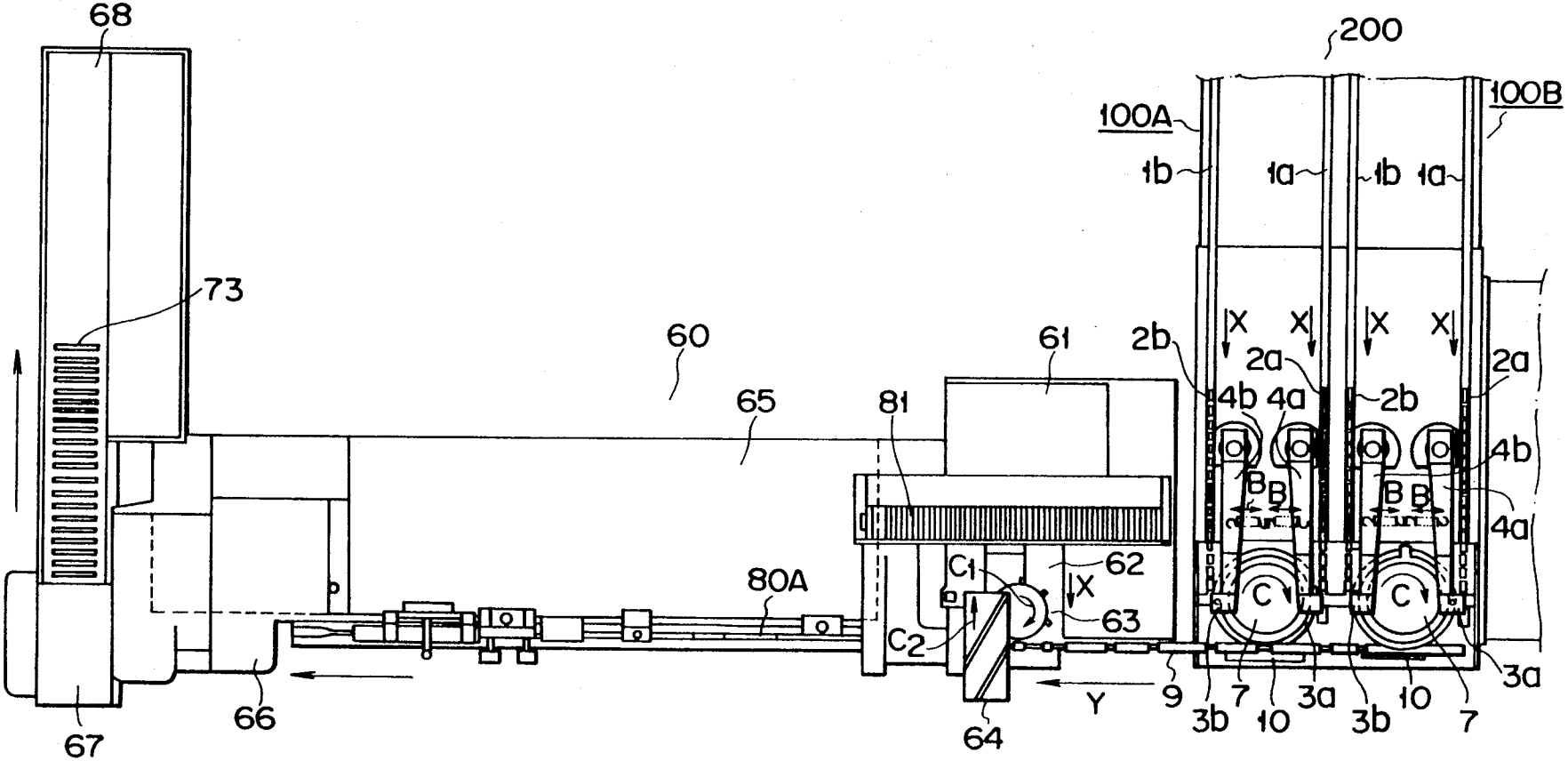
FIG. 4 is a general plane view of an apparatus of a first embodiment of the present invention.

Embodiments of the present invention will be explained with reference to the drawings. These embodiments show a apparatus for arranging cigarette water capsules in a state that their front and back portions are alternately opposed. FIGS. 4 to 7 show a first embodiment of the present invention.

In the drawings, in a capsule arranging apparatus 200, two capsules are arranged and units 100A and 100B are provided in parallel to each other. These units have the similar structure. First of all, the structure common to these units 100A and 100B will be explained.

Figure 6:
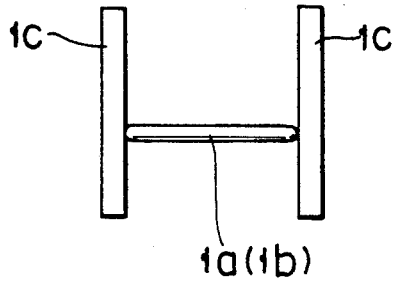
FIG. 6 is a cross sectional view taken along lines A—A.

Supply conveyers 1*a* and 1*b* of water capsules running in a direction of an arrow X comprise a wall 1*c* in both side surfaces as shown in the side view of FIG. 6. The water capsules 2*a* and 2*b* on the conveyers 1*a* and 1*b* are supplied on the supply conveyers 1*a* and 1*b* from a capsule supply source (not shown). The direction of the capsules 2*a* and 2*b* are arranged in order that their caps 20 are directed to the front side of the conveyer running direction X as shown in the drawing.

Figure 7:
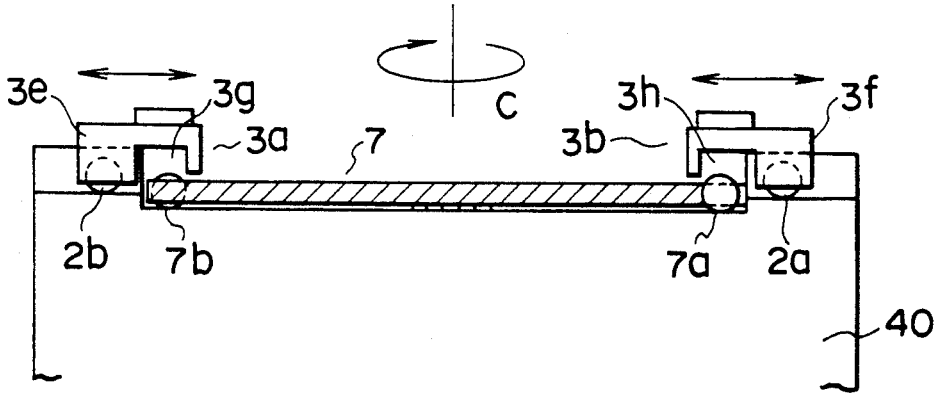
FIG. 7 is a cross sectional view taken along lines B—B.

In the final end portions of the conveyers 1*a* and 1*b*, there are provided transferring means, respectively. These transferring means comprise a pair of cross feeds 3*a* and 3*b*. These paired cross feeds 3*a* and 3*b* are fixed to the top ends of arms 4*a* and 4*b*, and moved back and forth in the direction of an arrow B upon driving the arms 4*a* and 4*b*. As shown in FIG. 7, the cross feeds 3*a* and 3*b* have hollow portions 3*g* and 3*h* for receiving the capsules 2*a* and 2*b* from side portions 3*e* and 3*f* and the supply conveyers 1*a* and 1*b*.

The arms 4*a* and 4*b* are rotatably provided in shafts 5*a* and 5*b* in the direction of an arrow B, and the driving force is given by a cam (not shown). Springs 6*a* and 6*b*, which are stretched between the pair of arms 4*a* and 4*b*, prevent the arm driving cam from being separated from its cam follower by inertia when the arms 4*a* and 4*b* are operated in the direction where they are separated from each other.

Figure 5:
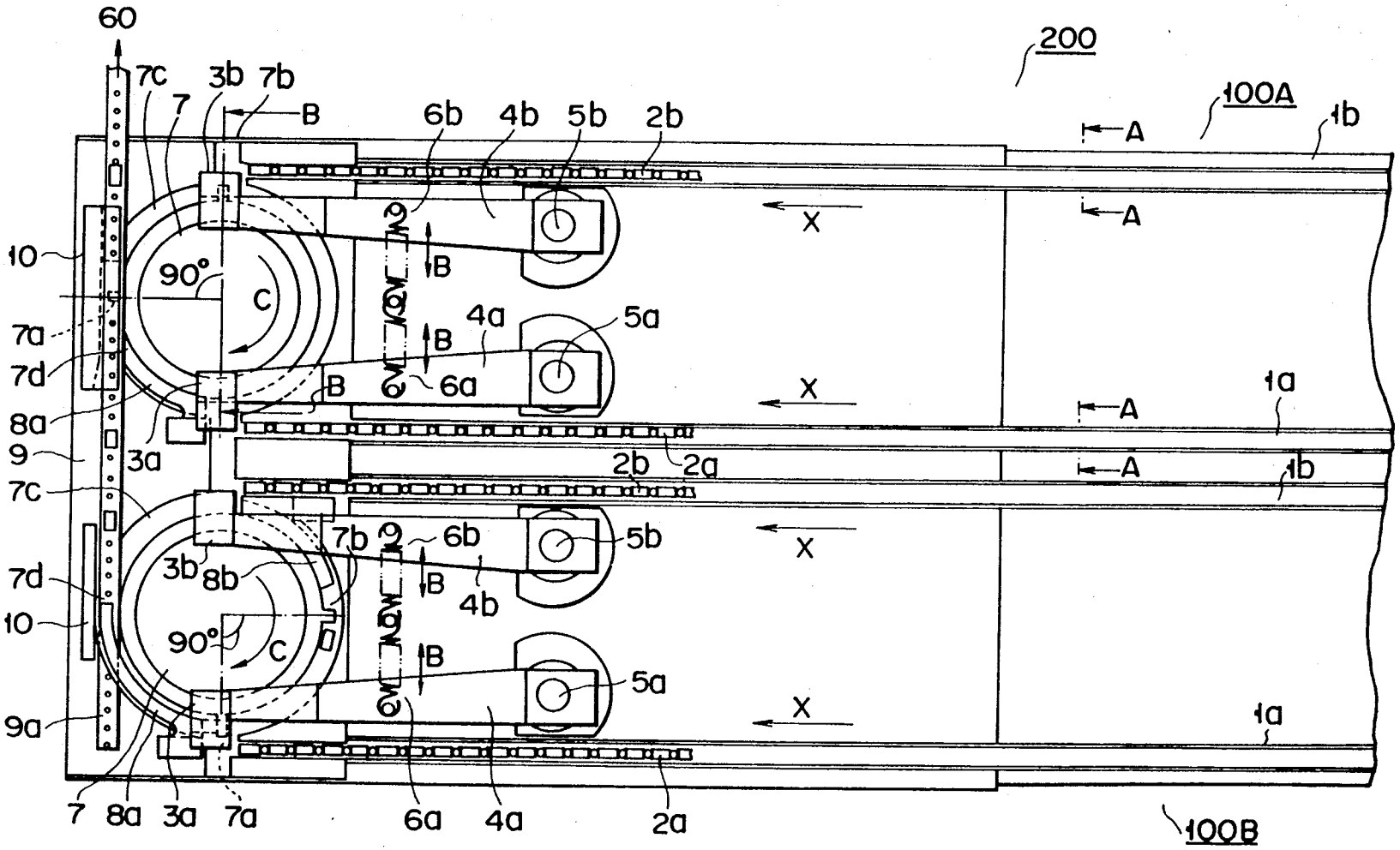
FIG. 5 is a plane view showing a partially enlarged apparatus of FIG. 4.

As shown in FIG. 7, ratchet wheels 7 concentrically are arranged in a concave portion of a circular base 40, that is, a guide groove, and rotate around a central axis in the direction of an arrow C. In the outer peripheral surfaces of the ratchet wheels 7, two feed claws 7*a* and 7*b* are projected. Just for information, FIG. 7 shows that the feed claws 7*a* and 7*b* are opposed each other. However, the feed claws 7*a* and 7*b* are actually 90° apart as shown in FIG. 5. Four feed claws 7*a* and 7*b* of the arranging apparatus are set in order that the relative angle can be selectively set and the capsules 2*a* and 2*b* are transferred to a suction band 9 with an equal distance. This setting is made to synchronously operate two units 100A and 100B to be explained later. Annular guide grooves 7*c* for guiding the capsules 2*a* and 2*b* are formed between the outer periphery surface of the ratchet wheel 7 and the inner periphery surface of the concave portion of the base 40. On the upper surface of the guide grooves 7*c*, there are arranged plate springs 8*a* and 8*b* (for example, plate thickness of 0.2 mm). The capsules 2*a* and 2*b* in the guide grooves 7*c* are elastically pressed by the lower surface of the plate springs 8*a* and 8*b*, and a predetermined sliding resistance is applied thereto. By the sliding resistance, the capsules 2*a* and 2*b* in the guide grooves 7*c* are prevented from being separated from the feed claws 7*a* and 7*b* and unfavorably moved.

The exhaust conveyer connected to a filter manufacturing apparatus 60, that is, the suction band 9, comprises a suction tip 9*a* (for example, diameter of about 2 mm) in its central portion, and sucks the capsules 2*a* and 2*b* from the inner side and retains these capsules. The surface positions of the suction surfaces are set to be slightly lower than the bottom surfaces of the guide grooves 7*c* of the ratchets 7. The suction band 9 runs in the direction of an arrow D by a guide member 10, and the capsules 2*a* and 2*b*, which were sucked and retained thereon, are transferred to the filter manufacturing apparatus 60.

A general operation of the arranging apparatus 200 will be explained.

The capsules 2*a* and 2*b* supplied from the capsule supply source are transferred to the cross feeds 3*a* and 3*b* by the supply conveyers 1*a* and 1*b*. In this case, the capsules 2*a* and 2*b* are arranged such that the sides of the caps 20 are directed to the front sides of the transferring direction, and there is no disadvantage in which flaps f of the edges of the caps 20 catch the joint portions of the transferring passages. Then, the capsules 2*a* and 2*b* of the front of the transferring direction (hereinafter called capsules $2a_1$ and $2b_1$) are sent to the hollow portions 3*b* and 3*h* while the center of the cross feed hollow portions 3*g* and 3*h* coincides with that of the supply conveyers 1*a* and 1*b*. The running velocity V (mm/min) of the supply conveyers 1*a* and 1*b* of the unit 100A and 100B, which is necessary to realize the above sending operation, is as follows:

$$V = l \times n \times 3 \times \tfrac{1}{2}$$

wherein a length [mm] of a capsule is l and the number of capsules to be supplied per minute is n [number/min]. For example, in a case where the length l of a capsule is 14 mm and the number n of capsules to be supplied per minute is 200/min, the following running velocity V of the supply conveyers can be obtained:

$$V = 14 \times 200 \times 3 \times \tfrac{1}{2} = 4200 \text{ [mm/min]}$$

At the time when the sending the capsules 2*al* and 2*bl* to the hollow portions 3*g* and 3*h* is finished, the cross feeds 3*a* and 3*b* are moved to the central direction of the ratchets 7 via the arms 4*a* and 4*b* by the driving force of the cam. During this movement, the top ends of the capsules $2a_1$ and $2b_2$ (that is, sides of the caps 20) are pressed by the cross feed side portions 3*c* and 3*d*, and the capsules $2a_1$ an $2b_2$ are stayed on the supply conveyers 1*a* and 1*b*. If the cross feeds 3*a* and 3*b* are positioned above the guide grooves 7*c*, the feed claws 7*a* and 7*b* press the back end of the capsule $2a_1$ (side of bottom 30) and the top end of the capsule $2b_2$ (side of cap 20), respectively.

By these operations, the capsules $2a_1$ and $2b_2$ are sent onto the suction band 9 along the guide grooves 7*c* via a guide groove outlet 7*d*. In this case, the capsules $2a_1$ and $2b_2$ are alternately sent in accordance with the rotation of the ratchet wheels 7, the directions thereof are opposed to each other. Similarly, the capsules sequentially following the capsules $2a_1$ and $2b_1$ are sent in a state that the paired capsules are directed to be opposed to each other.

Four feed claws 7*a* and 7*b* in the arranging apparatus 200 are 90° apart. Due to this, in one unit 100A, there is generated a distance corresponding to 270° of the rotation angle of ratchet 7 between one pair of the capsules 2, which are alternately sent on the suction band 9, and the following one pair to be supplied. The timing when one pair of the capsules 2 is sent from the ratchets 7 of the other unit 100B is consistent with the above distance. Therefore, two units 100A and 100B are not interrupted with other and synchronous operation can be performed.

Moreover, regarding the relationship between running speed S of the suction band 9 and capsule sending speed D due to the feed claws 7*a* and 7*b* of the ratchets, sending speed D is sent to be larger than the running speed S (for example, D=1. 1S). According to this relationship, the capsules 2 are correctly positioned on the suction band 9. Furthermore, the sending capsules 2 to the suction band 9 from the ratchets 7 is smoothly performed due to the suction tip 9*a* and the point that the surface position of the suction band 9 is slightly lower and the suction tip 9*a*. For example, there is not generated a disadvantage in which the sent capsules 2 are returned upon the rotation of the ratchets 7.

The capsule $2b_2$ in the guide grooves 7*c* is guided to the bottom 30. However, since the passing distance in the guide grooves 7*c* is relatively short and there is no seam in the inner surface, there is not generated a disadvantage in which flaps f catch the joint portions of the transferring passages.

Each of the capsules sent onto the suction band 9 is transferred to the filter manufacturing apparatus 60 while being sucked by the suction tip 9*a*. Though the filter manufacturing apparatus 60 is not an essential feature of the present invention, the operation thereof will be briefly explain as follows:

In this case, filter elements 74*a* and 74*b* in the water filter 73 are the same type to make the explanation simple.

A rod-shaped solid filter (not shown) supplied from a plug tray 61 is cut to a predetermined length by a cutting mechanism (not shown), thereby a large number of filter plugs 81 are formed. The filter plugs 81 are sent to the lower side of a spacer drum 64 through a conveyer 62 running in the direction of an arrow X and a delivery wheel 63 rotating in the direction of an arrow C. Also, the capsules 2, which are transferred in the direction an arrow Y by the suction band 9, are sent to the lower side of the spacer drum 64. The delivery wheel 63 is set such that the filter plugs are alternately arranged in series relative to the capsules 2. The spacer drum 64 rotates in the direction of an arrow $C_2$, and shortens the distance between the adjacent filter plugs 8 and the capsules 2.

In a drum 65, there is formed a rod 80A wherein filter plugs 81 are connected to the capsules 2 in series. A roll paper 75 is rolled around the rod 80A, thereby forming a water filter rod 80B (not shown in FIG. 4). The rod 80B is cut by a cutting portion 66, so that a single water filter 73 is formed. The water filter 73 is transferred to a transferring section 67. Then, the filter 73 is transferred to a process following the filter manufacturing apparatus 60 by a transferring belt 68.

Figure 8:
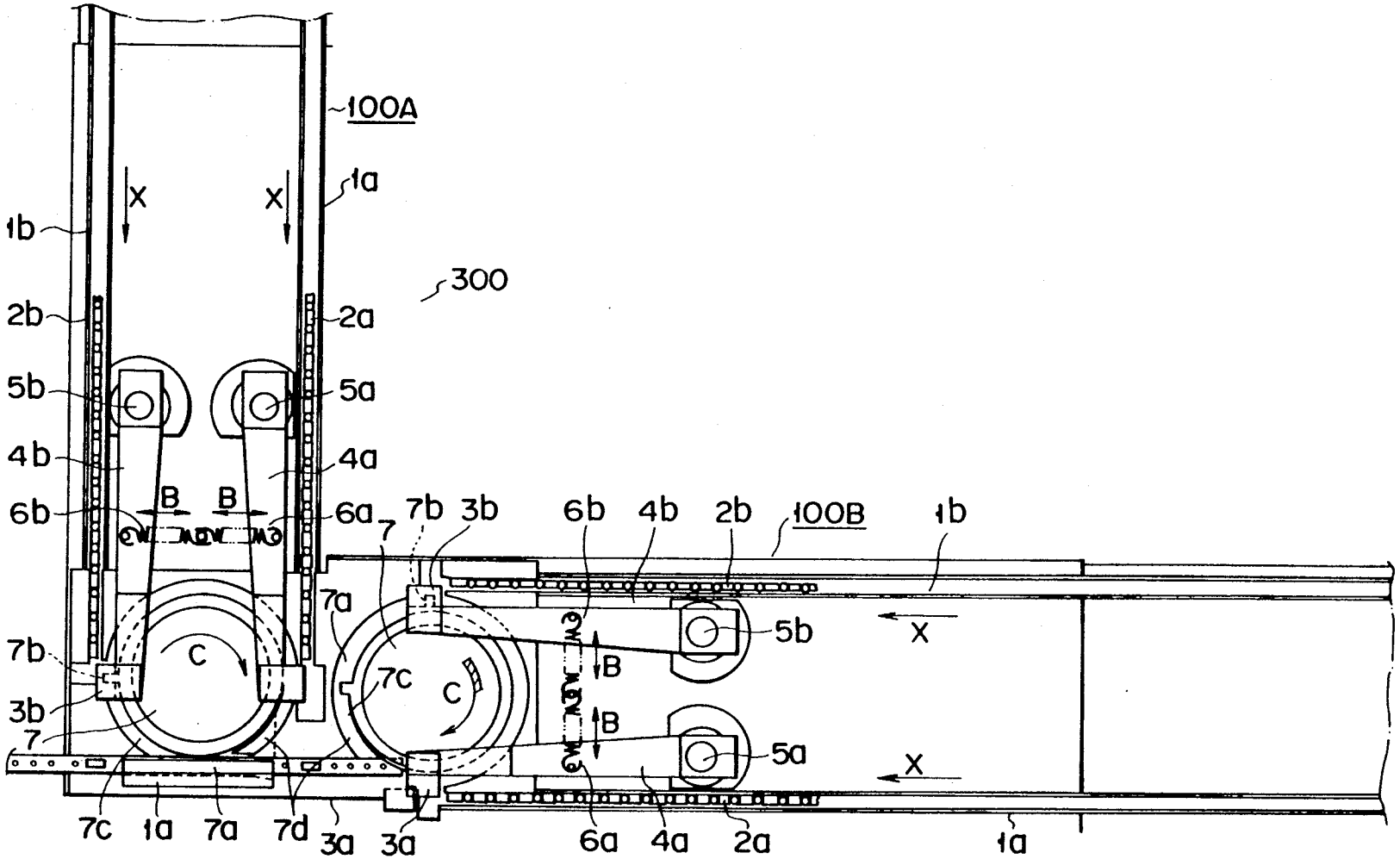
FIG. 8 is a plane view of an apparatus of a second embodiment of the present invention.

FIG. 8 shows a second embodiment of the transfer apparatus relating to the present invention. An arranging apparatus 300 in this embodiment comprises two units 100A and 100B similar to the first embodiment. However, in this embodiment, one unit 100B is arranged in order that the supply conveyers 1*a* and 1*b* and common suction band 9 are parallel to each other. In this case, in the unit 100B, the position of the guide groove outlet 7*d* of the ratchet wheels 7 is changed to the position, which is different from the case of FIG. 4 or FIG. 5, depending on the arrangement of the unit 100B.

Figure 9:
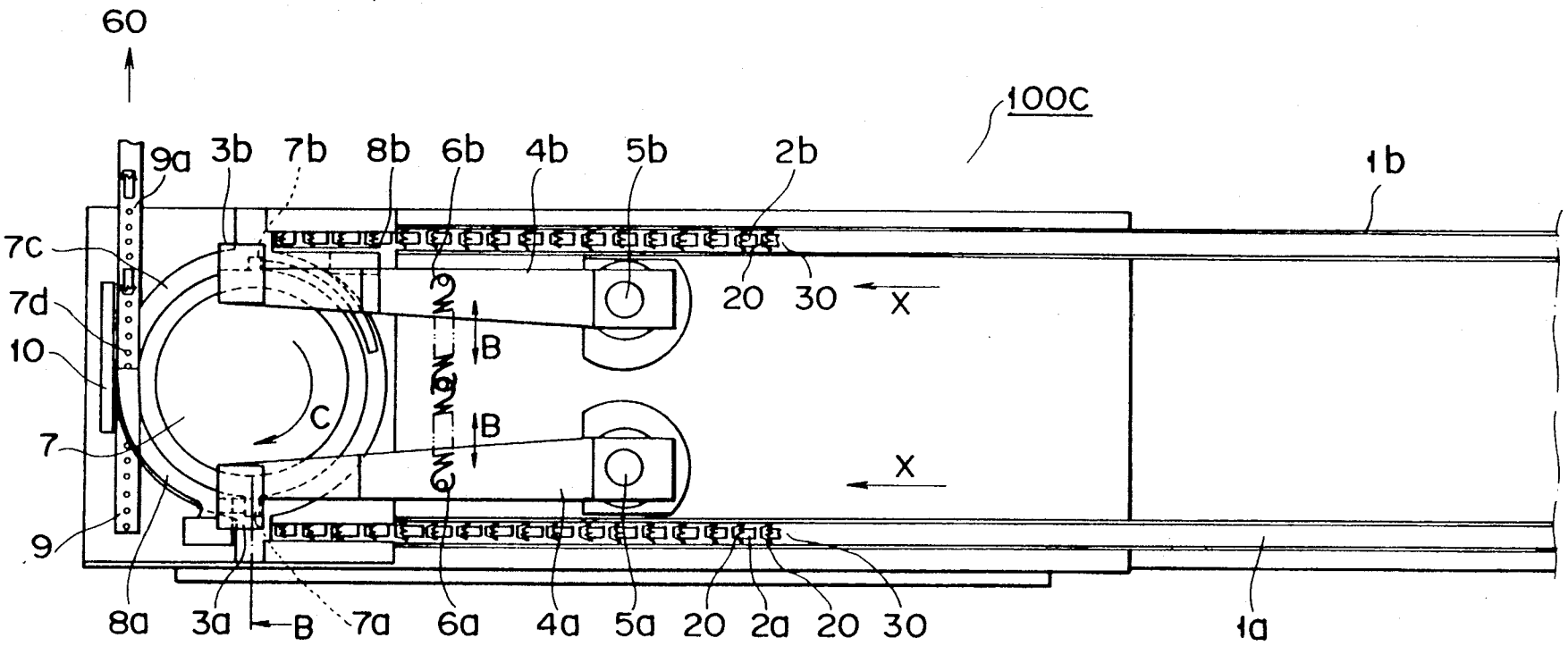
FIG. 9 is a plane view of an apparatus of a third embodiment of the present invention.

FIG. 9 is a third embodiment of the arranging apparatus relating to the present invention. This embodiment shows an example in which only a single unit 100 C is used as a transferring apparatus.

The main structure of the unit 100C is similar to that of unit 100A or 100B. In this case, feed claws 7*a* and 7*b* of the ratchet 7 are 180° apart to be opposed to each other. Moreover, if the number of capsules 2, which is to be supplied to the manufacturing apparatus 60 from the transferring apparatus 100C per unit hour, is set to the same as the case of the embodiment of FIG. 4, the supply velocity of the supply conveyers 1*a* and 1*b* of the transferring apparatus 100*c* is twice as fast a that of the transferring apparatus 200 of FIG. 5.

The above embodiments explained the case in which the water capsules are used as a transferring article. The present invention is not limited to the water capsules.

Moreover, in the above embodiments, the suction band 9 was used as an exhaust conveyer for transferring the water capsules to the filter manufacturing apparatus 60. However, according to the present invention, the type of the exhaust conveyer and means for transferring the capsules to the exhaust conveyer from the annular guide grooves are not limited to the above-mentioned cases.

As mentioned above, according to the apparatus of the present invention, if the articles are supplied in a state that the directions of the articles are arranged, the directions of the articles can be alternately sent from the exhaust side. Due to this, it is unnecessary to provide the distributing work and a distributing mechanism wherein the directions of the articles are distributed in the process to be performed right before the arranging apparatus is used. Therefore, the high speed performance of the apparatus can be easily made.

Moreover, since two supply conveyers are provided in the apparatus, processing ability can be improved as compared with the conventional apparatus having a single supply conveyer.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for arranging articles having front and back end portions different from each other to direct said front and back portions to be alternately opposed to each other, comprising:

a base in which annular guide grooves are formed;

feeding means having ratchet wheels rotating around the center of said annular guide grooves as a center of rotation, and feed claws formed in the outer periphery of said ratchet wheels and moving in a circumferential direction along said annular guide grooves by the rotation of said ratchet wheels;

first and second supply conveyers supplying said articles in into said annular guide grooves, and said first and second conveyers transferring said articles in a state that said front and back portions of said articles are arranged in the same direction relative to the advancing direction;

top end portion of said first supply conveyer arranged in a direction of a contact line relative to said annular guide grooves to be positioned in a direction where the advancing direction of said articles to be supplied on said top end portion is the same as the moving direction of said feed claws;

top end portion of said second supply conveyer arranged in a direction of a contact line relative to said annular guide grooves to be positioned in a direction where the advancing direction of the articles to be supplied on said top end portion is opposite to the moving direction of said feed claw;

supply means for supplying said articles fed on said first and second supply conveyers to said annular guide grooves in said top end portions of said first and second supply conveyers;

an exhaust conveyer provided close to said annular guide grooves; and exhausting means for exhausting said articles, which are pressed by said feed claws and moved in said annular guide grooves, on said exhaust conveyer.

2. The apparatus according to claim 1, wherein said first and second supply conveyers are arranged to be parallel to each other, said top end portion of said first supply conveyer and said top end portion of said second supply conveyer are respectively arranged at the position where these top end portions are 180° apart from each other in the circumferential direction of said annular guide grooves, and said articles to be transferred on said first and second supply conveyers are transferred to the position where said annular guide grooves are 180° apart from each other.

3. The apparatus according to claim 1, wherein a concave portion whose plane is circular-shaped is formed in said base, said ratchets are disc-shaped, said disc-shaped ratchets are concentrically arranged in said concave portion, and said annular guide grooves are formed between the outer peripheries of said disc-shaped ratchets and the inner periphery surface of said circular concave portion.

4. The apparatus according to claim 1, wherein said feed claws are projected at two portions where said outer peripheries of said ratchet are 90° apart from each other.

* * * * *